US008141725B2

(12) United States Patent
Omori et al.

(10) Patent No.: US 8,141,725 B2
(45) Date of Patent: Mar. 27, 2012

(54) JIB CRANE

(75) Inventors: Daisuke Omori, Chuo-ku (JP); Isao Miyazawa, Chuo-ku (JP); Toshinori Fukumoto, Chuo-ku (JP); Seikichi Tanaka, Chuo-ku (JP)

(73) Assignee: Ishikawajima Transport Machinery Co., Ltd., Tokyo (JP)

( * ) Notice: Subject to any disclaimer, the term of this patent is extended or adjusted under 35 U.S.C. 154(b) by 451 days.

(21) Appl. No.: 12/444,805

(22) PCT Filed: Oct. 16, 2007

(86) PCT No.: PCT/JP2007/001119

§ 371 (c)(1),
(2), (4) Date: Apr. 8, 2009

(87) PCT Pub. No.: WO2008/047471

PCT Pub. Date: Apr. 24, 2008

(65) Prior Publication Data

US 2010/0072157 A1 Mar. 25, 2010

(30) Foreign Application Priority Data

Oct. 17, 2006 (JP) ..... 2006-282532

(51) Int. Cl.
*B66C 23/82* (2006.01)

(52) U.S. Cl. ..... 212/240; 212/239; 212/262; 212/175

(58) Field of Classification Search ..... 212/239, 212/262, 175, 240

See application file for complete search history.

(56) References Cited

U.S. PATENT DOCUMENTS

| | | | | |
|---|---|---|---|---|
| 4,579,234 | A * | 4/1986 | Delago et al. | 212/178 |
| 4,610,365 | A * | 9/1986 | Roed | 212/262 |
| 6,508,371 | B2 | 1/2003 | Miyazawa | |

FOREIGN PATENT DOCUMENTS

| | | |
|---|---|---|
| JP | 52 135150 | 11/1977 |
| JP | 2001 130870 | 5/2001 |
| JP | 2002 53289 | 2/2002 |
| SU | 933621 | 6/1982 |
| SU | 1572988 A1 | 6/1990 |

OTHER PUBLICATIONS

Singapore Search Report issued Apr. 28, 2010, in Singapore Patent Application No. 200902303-7.

* cited by examiner

*Primary Examiner* — Emmanuel M Marcelo
(74) *Attorney, Agent, or Firm* — Oblon, Spivak, McClelland, Maier & Neustadt, L.L.P.

(57) ABSTRACT

A jib crane which can prevent an unexpected movement of a burden and can sufficiently ensure the safety of a burden handling work is disclosed. The jib crane has hoisting wire ropes for lifting and landing a hook, derricking wire ropes for derricking operation of a jib, and a conversion device for fixing tips of the wire ropes to a revolving frame of a revolving table. The conversion device has a V-shaped link pivotally supported on a bearing bracket via a pivot pin. The tips of the wire ropes are connected to paired link arms of the V-shaped link.

2 Claims, 5 Drawing Sheets

JIB CRANE

TECHNICAL FIELD

The present invention relates to a jib crane for use in transportation of a heavy burden.

BACKGROUND OF THE INVENTION

Some jib cranes are arranged, for example, in shipbuilding yards for use in transportation of heavy burdens. This kind of jib crane comprises an upper revolving table and a jib protruding from the revolving table (see, for example, Patent Literature 1 showing a climbing crane as jib crane). The jib has a base end pivoted on the revolving table and may be derricked through lead-in or pull-out of derricking wire ropes. A hanger such as a hook is suspended from a tip of the jib via hoisting wire ropes and a work of lifting and landing a burden hooked to the hanger, i.e., a burden handling work is carried out by reeling and unreeling the hoisting wire rope.
[Patent Literature 1] JP2001-130870A

SUMMARY OF INVENTION

Technical Problems

During the burden handling work, load of the burden is applied through the hoisting wire ropes to the jib which is then inevitably bent by the load. Thus, lift-off of the burden causes the tip of the jib to tilt forward due to the bending of the jib or other structure. When the jib is held at a predetermined upward derricking angle to the horizontal, such forward tilting causes a position of the hanged burden after the lift-off of the burden to be displaced forward of the jib relative to a plumb line of the burden in its lift-off position.

Contrary, when the burden is landed, the load applied to the jib is released to release the bending of the jib so that the tip of the jib is flipped up to its original position. As a result, the burden on its landed position is dragged toward the base end of the jib through the hoisting wire rope and the hanger as the tip of the jib is flipped up.

The above-mentioned positional displacement of the hanged burden and dragging of the burden greatly and adversely affect on centering of a heavy burden during positioning of the burden mainly in a shipbuilding yard or the like, which may not only bring about deterioration in centering efficiency but also is undesirable from viewpoint of securing the safety in the work.

The invention was made in view of the above and has its object to provide a jib crane which can attain improvement in work efficiency and can sufficiently ensure the safety in the work.

Solution to Problems

In order to attain the above object, in a jib crane comprising a jib pivoted on a revolving table for derricking motion, a hoisting device having a hoisting drum on said revolving table with hoisting wire ropes being wound around the hoisting drum, a hanger being suspended by the hoisting wire ropes unreeled from said hoisting drum via a tip of the jib while tips of the hoisting wire ropes are fixed to the revolving table, the hanger being lifted and lowered by reeling and unreeling the hoisting wire ropes to and from the hoisting drum, and a derricking device having a derricking drum on the revolving table with derricking wire ropes being wound around the derricking drum, said jib being suspended by the derricking wire ropes unreeled from the derricking drum while tips of the derricking wire ropes are fixed to the revolving table, the jib being derricked by lead-in and pull-out of the derricking wire ropes to and from the derricking drum, the invention is directed to the jib crane comprising a conversion device on the revolving table for converting load applied to the hoisting wire ropes into lead-in of the derricking wire ropes during a burden handling work.

Specifically, the conversion device includes a link with a base end of said link being pivotally supported on the revolving table and tip ends of said link being connected to the tips of the hoisting and derricking wire ropes, respectively, said link being pivotable in one direction when load is transmitted by the hoisting wire ropes, and a stopper adjacent to the revolving table for preventing the link to be pivoted in the other direction upon contact with the link.

According to the above-mentioned jib crane, during the burden handling work, load of the burden applied to the hoisting wire ropes causes the conversion device, more specifically the link, to be pivoted in the one direction. This pivotal movement pulls the derricking wire ropes to lift the jib upwardly in a lead-in direction by a certain angle. As a result, the derricking angle of the jib is increased so that, even if forward tilting of a tip of the jib is caused due to bending of the jib and other structure, displacement in suspended position due to such forward tilting is compensated to position the suspended and lift-off positions of the burden on a same plumb line.

Contrary, when the burden is landed, the load applied to the hoisting wire ropes is relieved to eliminated the forward tilting of the jib, the link being pivoted reversely until it abuts on the stopper, which causes the jib to be lowered by said angle. Thus, even if the tip of the jib is flipped up into the original state, the burden is not dragged from its landed position.

Preferably, the derricking wire ropes suspend a longitudinally intermediate portion of the jib, which can suppress the lowering of the tip of the jib due to tilting of the jib.

Advantageous Effects of Invention

According to a an embodiment of the invention, during a burden handling work, even if the tip of the jib is forwardly tilted due to its bending or such forward tilting is relieved, the suspended or landed position of the burden is not undesirably displaced. As a result, even in a case of heavy burden in a shipbuilding work, not only centering of the burden is facilitated to attain substantial improvement in centering efficiency, but also the burden handling work is made favorable from a viewpoint of ensuring safety.

REFERENCE SIGNS LIST

Figure 1:
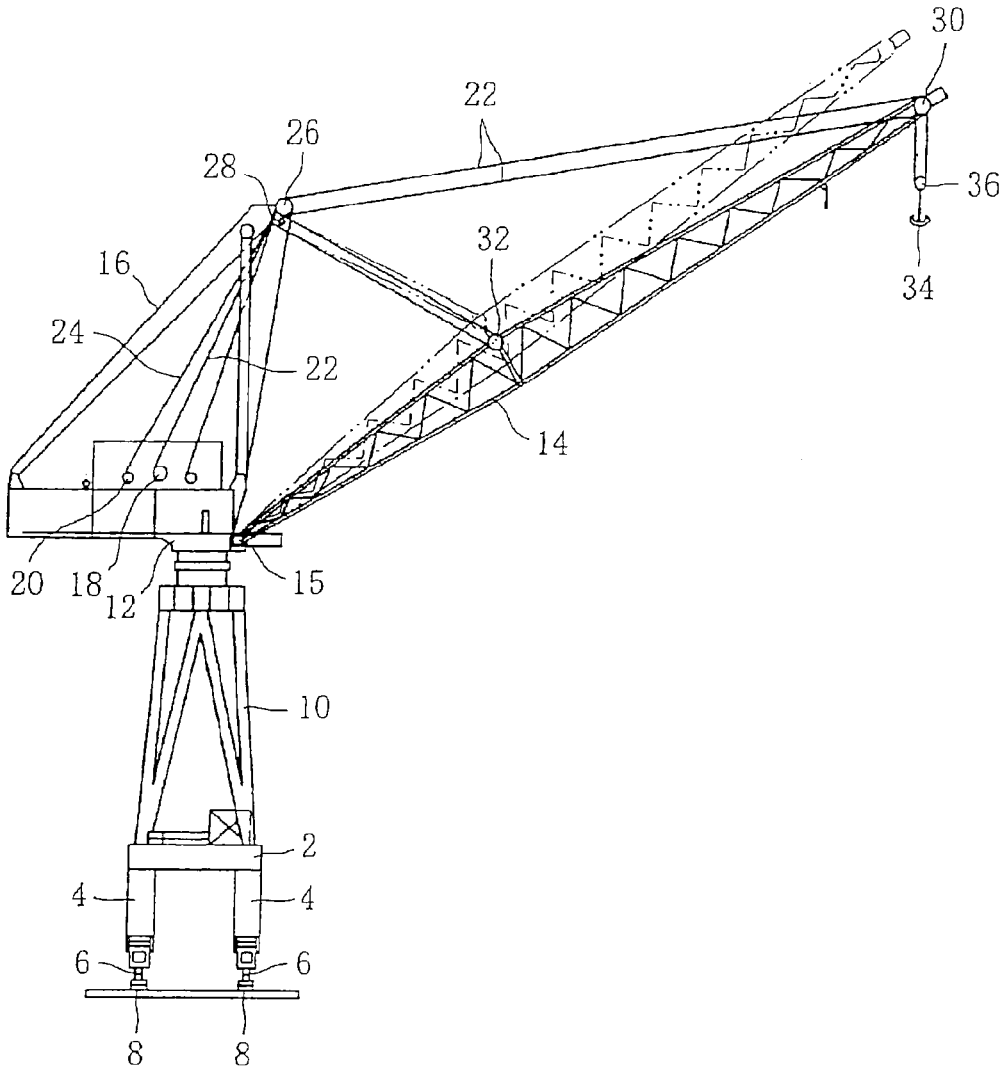
FIG. 1 is a side view of a traveling jib crane.

12 revolving table
14 jib

18 hoisting drum
20 derricking drum
22 hoisting wire rope
24 derricking wire rope
38 conversion device
62 V-shaped link
64 stopper

DESCRIPTION OF EMBODIMENT

FIG. 1 shows a traveling jib crane having a traveling body 2. The traveling body 2 has a plurality of legs 4 resting via wheels 6 on paired rails 8. Thus, the traveling body 2 can travel along the rails 8.

Constructed on the traveling body 2 is a portal frame 10 on which arranged is a revolving table 12 revolvable in horizontal plane. The revolving table 12 has a front portion from which a jib 14 extends, the jib 14 having a base end derrickably supported by the table 12 via a pivot 15.

Arranged on the revolving table 12 are an upper frame or so-called A frame 16, a hoisting drum 18 of a hoisting device and a derricking drum 20 of a derricking device. Wound around the hoisting drum 18 are paired hoisting wire ropes 22; and wound around the derricking drum 20 are paired derricking wire ropes 24. Base ends of the hoisting and derricking wire ropes 22 and 24 are fixed to the corresponding drums 18 and 20, respectively.

Arranged on an upper end of the upper frame 16 are a row of top sheaves 26 for the hoisting wire ropes 22 as well as a row of top sheaves 28 for the derricking wire ropes 24. Arranged on a tip of the jib 14 are a row of tip sheaves 30 for the hoisting wire ropes 22; and arranged on a longitudinally intermediate portion of the jib 14 are a row of suspending sheaves 32 for the derricking wire ropes 24.

Figure 2:
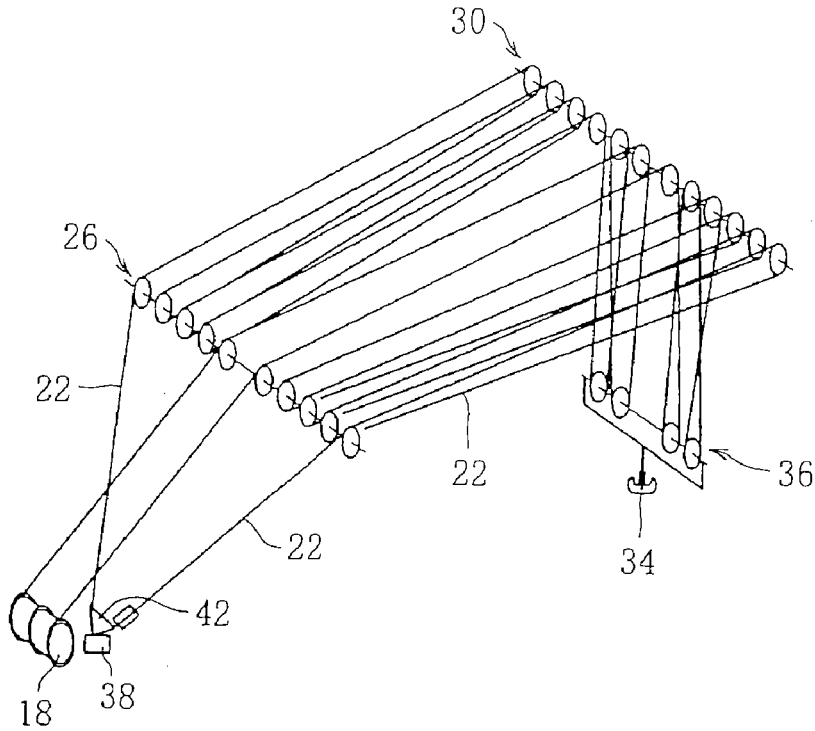
FIG. 2 is a view showing passing-over of hoisting wire ropes.

As is clear from FIG. 2, the hoisting wire ropes 22 from the drum 18 are guided via the top sheave row 26 to the tip sheave row 30, are passed over a row of lifting sheaves 36 with a hook (hanger) 34, are reciprocatingly passed for a plurality of times between the tip and top sheave rows 30 and 26, are returned from the top sheave row 26 toward the revolving table 12 and are fixed at their tips via a conversion device 38 to the revolving table 12. Thus, as the hoisting wire ropes 22 are reeled and unreeled in accordance with the rotation of the hoisting drum 18, the hook 34 is lifted and lowered.

Figure 3:
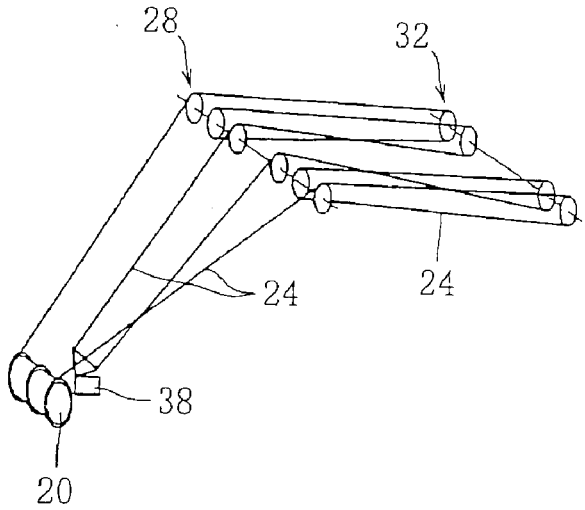
FIG. 3 is a view showing passing-over of derricking wire ropes.

As is clear from FIG. 3, the derricking wire ropes 24 from the drum 20 are guided via the top sheave row 28 to the suspending sheave row 32, are reciprocatingly passed for a plurality of times between the top and suspending sheave rows 28 and 32, are returned from the top sheave row 28 toward the revolving table 12 and are fixed at their tips via the conversion device 38 to the revolving table 12. Thus, as the derricking wire ropes 24 are reeled and unreeled in accordance with the rotation of the derricking drum 20, the jib 14 can be pivoted at its base end about the pivot 15, i.e., can be derricked.

Figure 4:
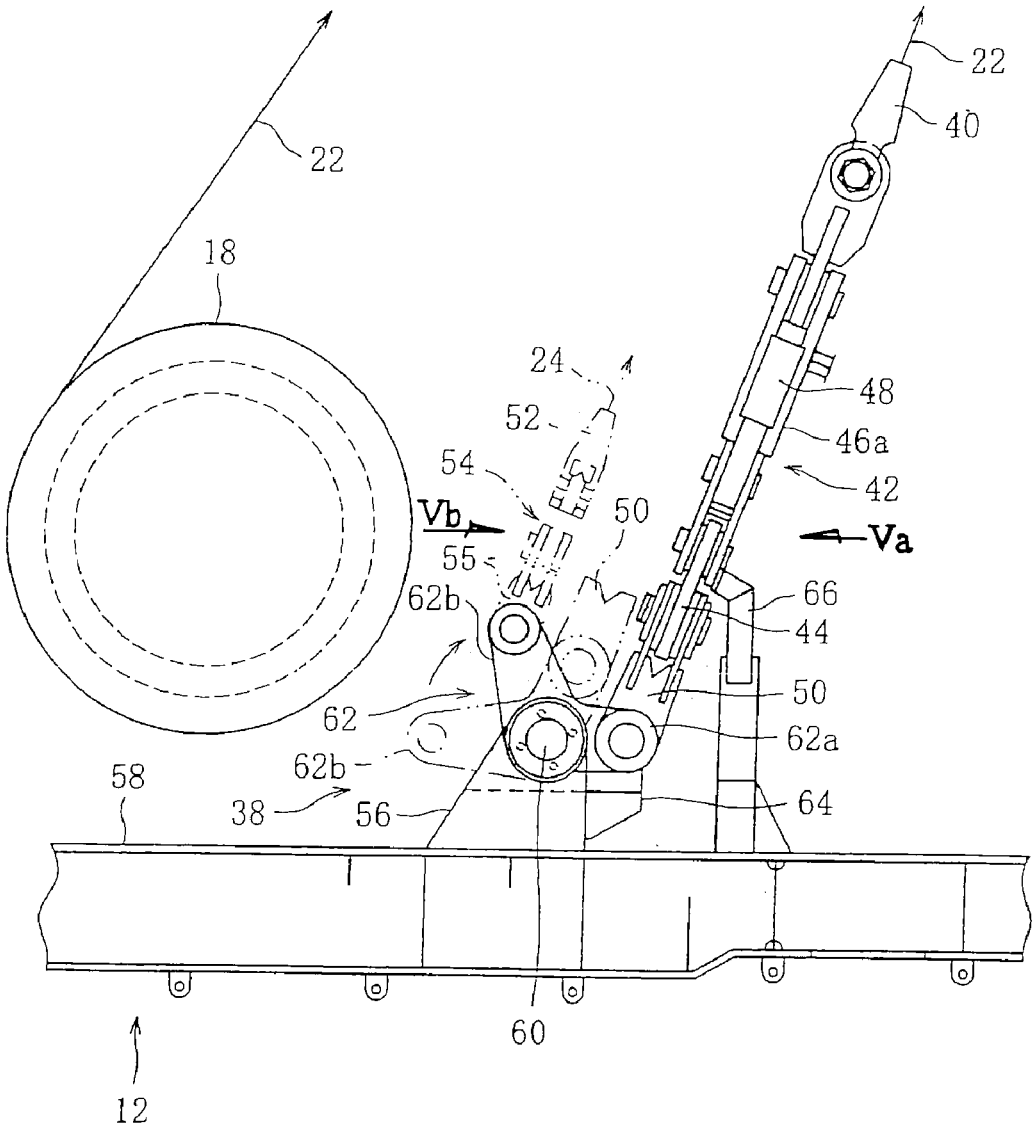
FIG. 4 is a side view showing a conversion device in an embodiment.
Figure 5:
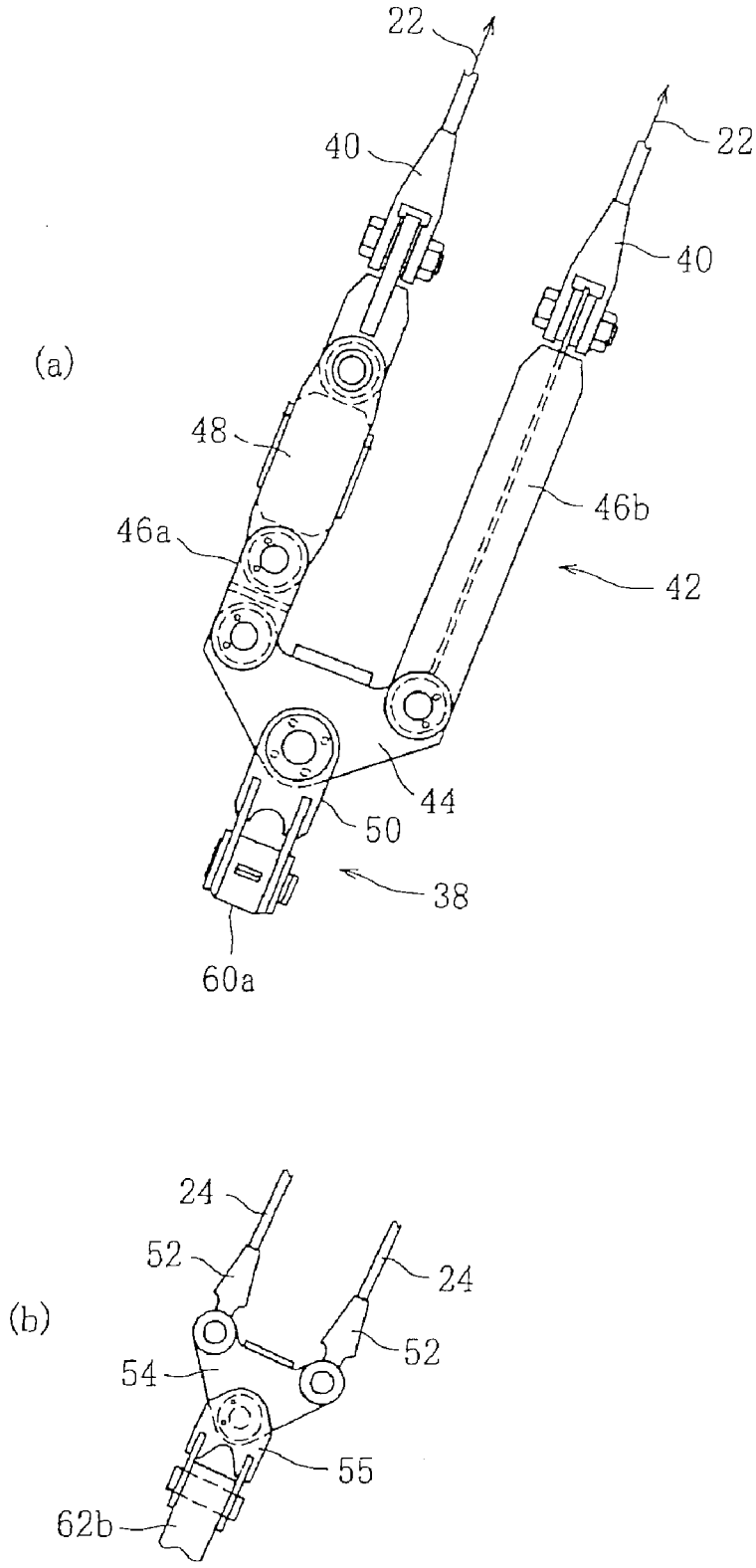
FIG. 5 shows vicinities of tips of hoisting and derricking wire ropes in which FIGS. 5(*a*) and 5(*b*) are views looking in directions of arrows Va and Vb in FIG. 4, respectively.

FIGS. 4 and 5 specifically show vicinities of the tips of the hoisting and derricking wire ropes 22 and 24.

The respective hoisting wire ropes 22 are connected at their tips to connecting fittings 40, respectively, which in turn are connected to a hoisting equalizer 42. As is clear from FIG. 5(*a*), the hoisting equalizer 42 is substantially U-shaped and comprises a base 44 in the form of downwardly directed triangle and paired arms 46*a* and 46*b* extends upward from opposite upper ends of the base 44. The respective arms 46 have base ends pivotally connected to the base 44 and tip ends connected to the tips of the hoisting wire ropes 22 through the connecting fittings 40.

More specifically, one 46*a* of the paired arms 46*a* and 46*b* is divided longitudinally into parts, the divided parts being connected together via a load cell 48 which is a load sensor for detection of load applied to the hoisting wire rope 22.

The base 44 has a lower portion from which a connecting fitting 50 pivotally extends, the connecting fitting 50 being connected to the above-mentioned conversion device 38.

As shown in FIG. 5(*b*), the paired derricking wire ropes 24 are connected at their tips to the conversion device 38 via connecting fittings 52, a derricking equalizer 54 and a connecting fitting 55 which are similar to the above-mentioned connecting fittings 40, hoisting equalizer 42 and connecting fitting 50, respectively.

Next, the conversion device 38 will be detailed.

As shown in FIG. 4, the conversion device 38 comprises a bearing bracket 56 arranged on and fixed to a revolving frame 58 of the revolving table 12. Pivotally supported on the bearing bracket 56 via a pivot pin 60 is a base end of a V-shaped link 62 which has opposite link arms 62*a* and 62*b* with tip ends to which in turn pivotally connected are the connecting fittings 50 and 55 of the hoisting and derricking equalizers 42 and 54, respectively. Thus, the tips of the hoisting and derricking wire ropes 22 and 24 are fixed via the V-shaped link 62 to the revolving table 12.

Mounted on the bearing bracket 56 is a stopper 64 on which abuts the link arm 62*a* of the link 62 when the link 62 is in a condition shown in FIG. 4 so as to prevent the pivotal movement of the link 62 in a clockwise direction in FIG. 4. In other words, tension always applied to the derricking wire ropes 24, which suspend the jib 14, urges the link 62 to be pivoted clockwise in FIG. 4 so that the link 62 is held in a condition where the link arm 62*a* adjacent to the hoisting wire rope 22 abuts on the stopper 64.

In FIG. 4, reference numeral 66 denotes an anti-vibration fitting for the hoisting equalizer 42 and arranged on the revolving frame 58.

Next, an operation of the above-mentioned conversion device 38 will be explained in conjunction with FIG. 6.

Figure 6:
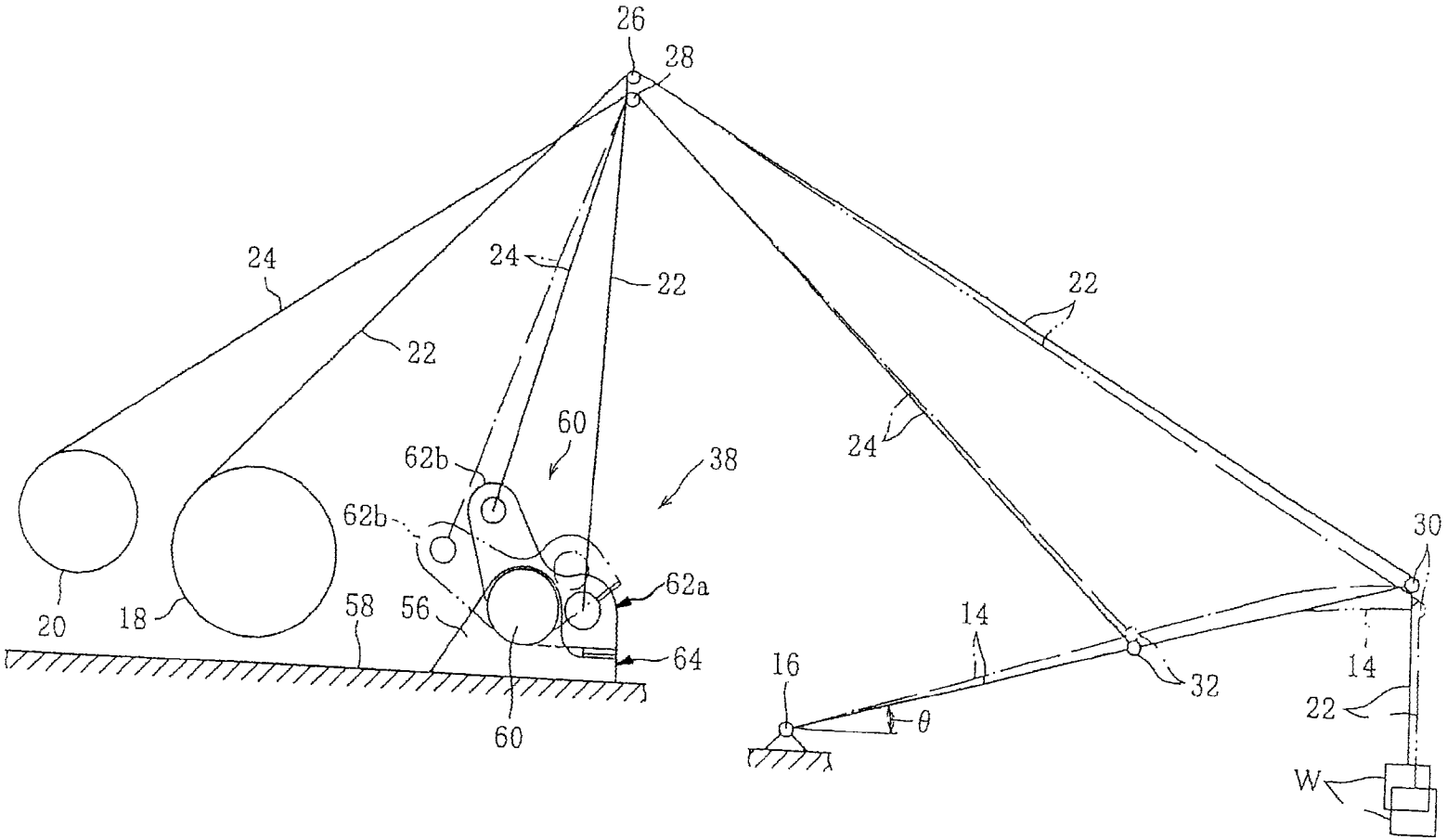
FIG. 6 is a view for explanation of operation of the conversion device shown in FIG. 4.

In a burden handling work by the jib crane, the jib 14 receives load of a burden W through the hoisting wire ropes 22 so that the jib 14 is bent due to the load, the tip end of the jib being lowered as shown in chain double-dashed line in FIG. 6. At this time, the jib 14 has an upwardly inclined derricking angle θ and, if the above-mentioned conversion device 38 were not provided, the suspended position of the burden W would be displaced into position shown in chain double-dashed line forwardly of the jib 14 relative to the plumb line of the burden W on its lift-off position shown in solid lines.

However, the load of the burden W contributes to the tension of the hoisting wire ropes 22 so that, when the tension of the ropes 22 overcomes the tension applied to the derricking wire ropes 24, the link 62 is pivoted in counterclockwise as shown in chain dashed line in FIG. 6. Such pivotal movement of the link 62 lengthens path lengths of the derricking wire ropes 24 between their tips and the top sheave row 28 so that path lengths of the same between the top and suspending sheave rows 28 and 32 are decreased in compensation therefor. As a result, the jib 14 is raised by the derricking wire ropes 24 as shown in chain dashed line and the derricking angle θ is increased.

Such increase in derricking angle θ causes the tip of the jib 14 to be displaced toward the base end of the jib, so that the displacement of the burden W due to the above-mentioned lowering is compensated to maintain the suspended position of the burden W at the plumb line on the lift-off position.

More specifically, in the V-shaped link 62, effective length of the link arm 62*b* is decided in view of the above-mentioned bending amount of the jib 14, i.e., the lowered amount of its tip end.

On the other hand, when the burden W is landed, the tension applied to the hoisting wire ropes 22 is reduced so that the V-shaped link 62 is returned clockwise in FIG. 6 due to the tension of the derricking wire ropes 24 while the lowering at the tip end of the jib 14 is released and the tip of the jib is flipped up to its original condition. The returning of the V-shaped link 62 is stopped when the link arm 62*a* abuts on the stopper 64.

The returning of the V-shaped link 62 tilts the jib 14 and decreases its derricking angle θ so that the lowering and flip-up of the tip of the jib 14 get balanced out. As a result, no dragging of the burden W due to the above-mentioned flip-up is caused at the landed position of the burden W, so that the burden W can be accurately positioned at the targeted lift-down position.

As a result, when the jib crane is used for transportation and positioning of a heavy burden during a shipbuilding work, centering of the heavy burden is facilitated to attain substantial improvement in centering efficiency. Moreover, in the burden handling work, no unexpected movement of the burden W is caused so that safety in the work can be sufficiently ensured.

Moreover, the derricking wire ropes 24 suspend not a tip but an intermediate portion of the jib 14, so that the lowering of the tip of the jib 14 can be suppressed to greatly contribute to reduction in size of the above-mentioned conversion device 38.

It is to be understood that the invention is not limited to the above-mentioned embodiment and that various changes and modifications may be made.

For example, the invention is applicable not only to a traveling jib crane but also any other type of jib crane such as climbing crane.

The invention claimed is:

1. A jib crane comprising:

a jib pivoted to a revolving table for derricking motion;

a hoisting device having a hoisting drum on said revolving table with hoisting wire ropes being wound around the hoisting drum, a hanger being suspended by the hoisting wire ropes unreeled from the hoisting drum via a tip of the jib while tips of the hoisting wire ropes are fixed to said revolving table, said hanger being lifted and lowered by reeling and unreeling said hoisting wire ropes to and from said hoisting drum; and a derricking device having a derricking drum on said revolving table with derricking wire ropes being wound around the derricking drum, said jib being suspended by the derricking wire ropes unreeled from the derricking drum while tips of said derricking wire ropes are fixed to said revolving table, said jib being derricked by lead-in and pull-out of said derricking wire ropes to and from said derricking drum, wherein:

the jib crane comprises a conversion device on said revolving table for converting load applied to said hoisting wire ropes into lead-in of said derricking wire ropes during a burden handling work, and said conversion device comprises:

a link with a base end of said link being pivotally supported on said revolving table and with tip ends of said link being connected to the tips of said hoisting and derricking wire ropes, respectively, said link being pivotable in one direction when said load is transmitted via said hoisting wire ropes, and a stopper adjacent to said revolving table for preventing the link to be pivoted in the other direction upon contact with said link.

2. The jib crane as claimed in claim 1, wherein said derricking wire ropes suspend a longitudinally intermediate portion of the jib.

* * * * *